US006698673B1

(12) United States Patent
Hlousek

(10) Patent No.: US 6,698,673 B1
(45) Date of Patent: Mar. 2, 2004

(54) INJECTOR FOR FUEL INJECTION TAKING PLACE UNDER HIGH PRESSURE

(75) Inventor: Jaroslaw Hlousek, Golling (AT)

(73) Assignee: Robert Bosch GmbH, Stuttgart (DE)

( * ) Notice: Subject to any disclaimer, the term of this patent is extended or adjusted under 35 U.S.C. 154(b) by 152 days.

(21) Appl. No.: 09/889,891

(22) PCT Filed: Nov. 10, 2000

(86) PCT No.: PCT/DE00/04005

§ 371 (c)(1),
(2), (4) Date: Nov. 13, 2001

(87) PCT Pub. No.: WO01/38721

PCT Pub. Date: May 31, 2001

(30) Foreign Application Priority Data

Nov. 24, 1999 (DE) ..... 199 56 522

(51) Int. Cl.[7] ..... F02M 59/00; B05B 1/30

(52) U.S. Cl. ..... 239/585.1; 239/585.2; 239/585.4; 239/585.5; 239/533.2

(58) Field of Search ..... 239/585.1, 585.2, 239/585.3, 585.4, 585.5, 533.2, 533.3, 533.9, 533.11, 533.13, 900, 88, 89, 90, 91; 251/129.15, 129.21, 127

(56) References Cited

U.S. PATENT DOCUMENTS

| | | | | | |
|---|---|---|---|---|---|
| 4,284,049 | A | * | 8/1981 | Chmela | 123/467 |
| 4,529,165 | A | * | 7/1985 | Lehrach | 251/129.16 |
| 4,628,881 | A | * | 12/1986 | Beck et al. | 123/447 |
| 5,239,968 | A | * | 8/1993 | Rodriguez-Amaya et al. | 123/506 |
| 5,299,346 | A | * | 4/1994 | Kilgore et al. | 29/33 K |
| 5,673,853 | A | * | 10/1997 | Crofts et al. | 239/88 |
| 6,109,542 | A | | 8/2000 | Gant et al. | |

FOREIGN PATENT DOCUMENTS

| | | |
|---|---|---|
| EP | 0 418 601 B | 3/1991 |
| EP | 0 675 281 B | 10/1995 |

* cited by examiner

*Primary Examiner*—Davis Hwu
(74) *Attorney, Agent, or Firm*—Ronald E. Greigg

(57) ABSTRACT

The invention relates to an injector for injecting a fluid under high pressure by means of a nozzle. The injector element includes a high pressure inlet line as well as a pressureless outlet. The injector element is connected with a common high pressure collection space (common rail) and contains a solenoid valve which serves to actuate the nozzle. An axially extending casing is movably accommodated in the injector element, the one face of which is actuatable by means of a valve and the other face of which bounds a control space in which a branch of a high pressure inlet opens.

10 Claims, 2 Drawing Sheets

INJECTOR FOR FUEL INJECTION TAKING PLACE UNDER HIGH PRESSURE

CROSS-REFERENCE TO RELATED APPLICATIONS

This application is a 35 USC 371 application of PCT/DE 00/04005 filed on Nov. 10, 2000.

BACKGROUND OF THE INVENTION

1. Field of the Invention

Injectors for fuel standing under extremely high pressure have a valve controlling the injection process, as well as a nozzle needle projecting into the combustion chamber of an internal combustion machine. For actuation of the injectors, these as a rule are equipped with solenoid valves with which the shortest actuation times can be realized.

2. Description of the Prior Art

Injectors for internal combustion machines have been disclosed on the basis of the state of the art which can be outfitted with multiway valves. As a rule, solenoid valves are used for actuating injectors with which very short operating times can be realized. Since the injectors in certain injector ranges can be acted upon by pressures up to 1600 bar in order to produce an injection process in connection with extremely highly compressing diesel motors, leakage losses arise on the surfaces upon which relative motions occur through moving parts and on the components which separate highest pressure spaces from such with (viewed in relation to them) lower pressures. Leakage losses arise from injection process to injection process and can, for example, be adjusted by needle diameter and by control valve diameter. Leakage losses of fuel in the combustion chamber of an internal combustion machine can lead to so-called "redieseling" after switching the machine off it, for example, leakage losses occur on the nozzle needle opening into the combustion chamber. In contrast, leakage losses can just as well occur at the opposite end of the injector, perhaps on the solenoid valve serving as a 2/2 way valve.

SUMMARY OF THE INVENTION

With the injector solution of the invention for highest fuel injector pressures, leakage losses at the nozzle needle valve from injection process to injection process can be prevented. The losses arising on the magnet-side end of the injector in the region of the throttle merely represent solenoid valve control amount losses which can be returned to the storage tank again through a return line. If the injector is not subjected to systemic pressure, then a locking spring accommodated on the solenoid valve assures that the casing and the nozzle needle are pressed in the direction of the nozzle needle seat, and this remains shut against the combustion chamber. If the injector in contrast is acted upon with systemic pressure, then the fuel entering through the junction into the nozzle needle control space under high pressure makes it possible for the nozzle needle projecting into the nozzle needle control space to be likewise acted upon with high fuel systemic pressure on its face. Since the diameter on the nozzle needle is dimensioned larger on the control space side end than on the nozzle needle seat, a seating action is produced on the side of the nozzle through the pressurization of the nozzle needle control space at the end of the injector element.

Only when the solenoid valve accommodated in the injector element is subject to flow does a reduction in pressure take place in the nozzle needle control space. This is brought about in that the throttle opening is provided with a greater diameter on the solenoid valve side than the inlet throttle to the nozzle needle control space between the face end of the casing and the opposite end of the nozzle needle drops. The nozzle needle is moved through the high pressure arising now as before at the nozzle end to the control space side face of the casing. The injection process beings. The end of the injection process [tales] takes place through a pressure surge appearing in the axial bore hole of the casing after cessation of subjecting the solenoid valve to current. The pressure wave appearing in the axial bore hole of the casing after closing the solenoid valve is reproduced through this up into the nozzle needle control space and brings about a lightning-like pressing of the nozzle needle on its seat on the combustion chamber side end of the nozzle. This increase in pressure, also known as the "hammer pipe effect" acts on the side of the nozzle needle facing the nozzle needle control area, whose diameter is greater than the diameter of the nozzle needle at the nozzle needle seat. The nozzle needle closes the nozzle opening lightning-like through the rise in pressure in the casing such that leakage losses in solenoid valve control amount remain restricted.

A further advantage of the solution provided according to the invention is to be seen in the circumstance that only a minimal amount of subassemblies on the injector are required. It basically is a matter of the nozzle, the control valve, the casing and the injector element.

DESCRIPTION OF THE DRAWINGS

The invention is explained in greater detail herein below, with reference to the drawing in which.

DESCRIPTION OF THE PREFERRED EMBODIMENTS

Figure 1:
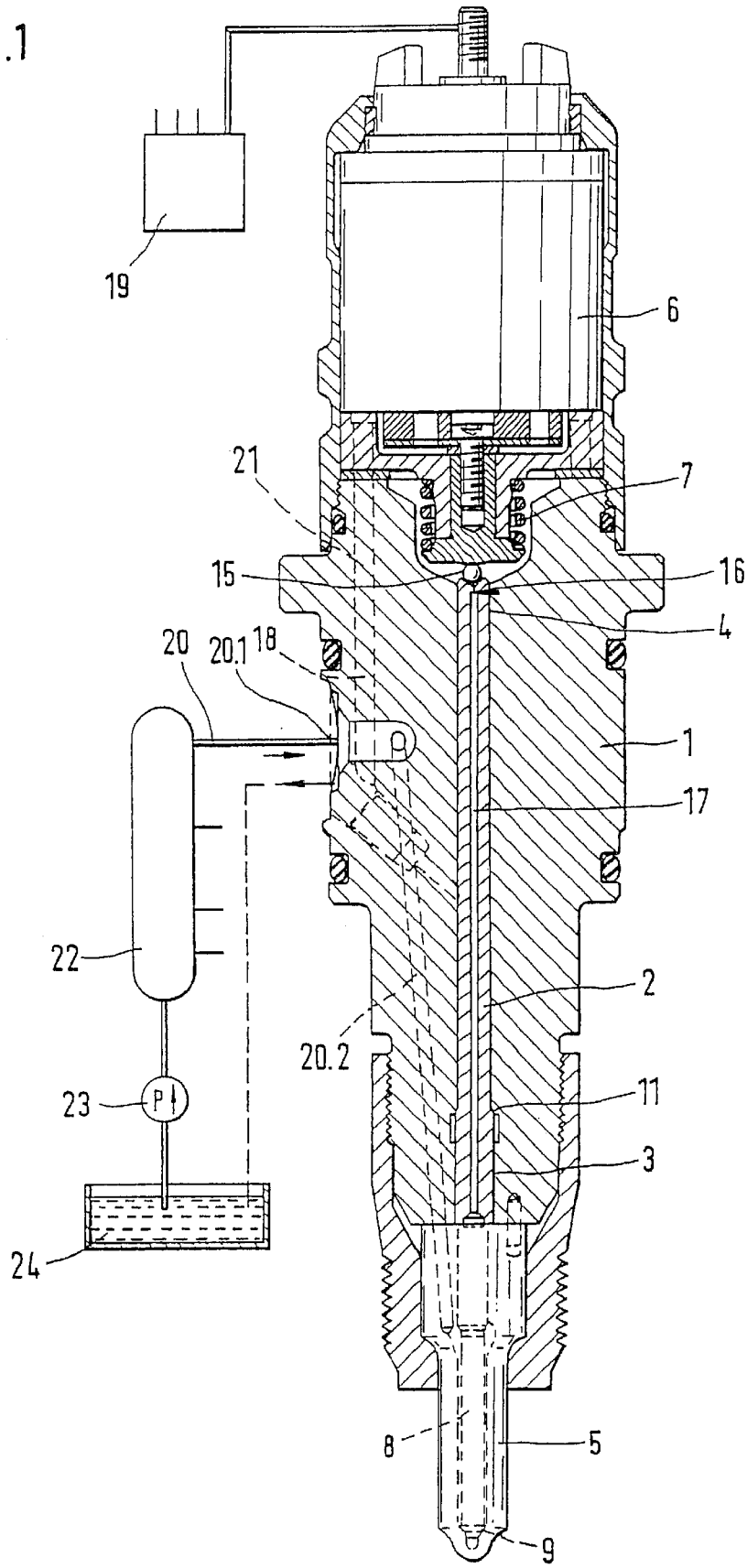
FIG. 1 Shows a longitudinal section through the injection element, which is connected with the storage tank on the inlet side with the high pressure collection space and on the discharge side with the storage tank, and FIG. 2 Depicts an enlarged detail representation of the nozzle needle control space between the casing penetrating the injection element and the nozzle needle.

In FIG. 1, a longitudinal section through an injection element is represented which is connected on the inlet side with a common high pressure collection room (common rail) and furthermore stands in connection with a storage tank through a pressureless outlet side.

The injection element 1 is pierced by a bore hole extending axially and into which a casing 2 is embedded. The casing 2 for its part is provided with an axial bore hole 17 and can be subdivided into two diameter regions with different play relative to the injector element. In a first diameter region 4, which extends from an inlet throttle 16 in the upper region to a tapered seat stop 11 in the area of nozzle 5 in injector element 1, the casing 2 has a play of >0.01 mm in the injector element, whereby the diameter of bore hole 17 lies in the area of 1.5 mm in the axially extending casing.

In the diameter region 3, extending from the tapered seat stop 11 up to casing face, the casing 2 is installed approximately free of play, and indeed with a play of <0.01 mm, which imposes very high standards on exactness of concentricity and the processing quality of the casing subassembly 2.

The injector element 1 accommodating the casing 2 has in its region projecting into the combustion chamber of an internal combustion machine a nozzle 5, which for its part encloses a nozzle needle 8. The nozzle 5 can be oriented relative to the injection element 1 by means of a centering pin 25 represented in dotted lines, whereby in addition to the use of the centering pin 25 for orientation, other centering elements can also be used. In the upper region of the injector element 1, a 2/2 way valve constructed as solenoid valve 6 is erected. Solenoid valve 6 acts on a globe valve 15 which is arranged above the casing 2 embedded in the injection element 1 whose throttle opening 16 is closed by valve 15. The magnetic element 6 is actuatable through a control unit 19, which is only indicated schematically in FIG. 1, is connected with solenoid valve 6 and actuates the latter.

The pressurization of the injector element 1 of the injector for injecting fuel under maximum pressures of more than 1600 bar takes place through an inlet pipe 20. Proceeding over the high pressure inlet 20 from the high pressure collection space 22 (common rail), the high pressure collection space 22 over the inlet opening 20.1 and the adjoining bore hole 20.2 in the injector element 1 stand in connection with each other. From a storage tank 24, fuel is conveyed by means of a high pressure pump 23 into the high pressure connection space 22 from which the individual high pressure inlets 20 area accommodated branching to the various injectors. In the construction variant represent, for example, four injectors on an internal combustion machine can be supplied with fuel standing under extremely high pressure through the high pressure collection space 22 (common rail). In addition, it is, of course, possible without further ado to provide branches to six or even eight injectors for 6 or 8 cylinder internal combustion machines.

In the upper region of injector element 1, the already mentioned solenoid valve 6 is found, which, on spherical valve 15, closes outlet throttle 16 of casing 2 or releases it when subjected to flow again. When the outlet throttle 16 is released by the solenoid valve 6, a well defined solenoid valve control amount of fuel enters through this opening 16 of the axially extending casing 2 into the free space around valve ball 15 above the spherical seat filled by the valve locking spring 7. The solenoid valve control amount reaches through a leakage conduit 21 extending through injector element 1 parallel to and offset from casing 2 and the pressureless outlet through bore hole 18, constructed as a separate bore hole in the injector element 1 back into storage tank 24 again. The solenoid valve amount therefore represents in this sense no loss, as it can enter into the part of the injection system accommodating the fuel conveyance.

A spring 7 accommodated between solenoid valve 6 and spherical seat 15 which presses the ball against outlet throttle 16 at the upper end of the casing 2 accommodated in the injector element 1 serves for accommodating the nozzle 5 in the region of nozzle needle seat 9. At the lower end of the injector element 1, nozzle needle control space 12 is constructed which is reproduced on enlarged scale in FIG. 2.

Nozzle needle control space 12 is bounded on the one side through the control space side face of casing 2, on the other through the end of nozzle needle 8 facing away from the nozzle opening. The branch 13 from high pressure line 20.2 opens into the nozzle needle control space which passes through injector element 1 proceeding from the opening 20.1. The high pressure bore hole 20.2 extends to nozzle 5 running on through injector element 1 which by way of example can be oriented by way of centering pin 25 toward nozzle 5. Compared with nozzle needle diameter 9 (cf. FIG. 1), the nozzle needle diameter 14 is constructed enlarged at the end of nozzle needle 8.

Figure 2:
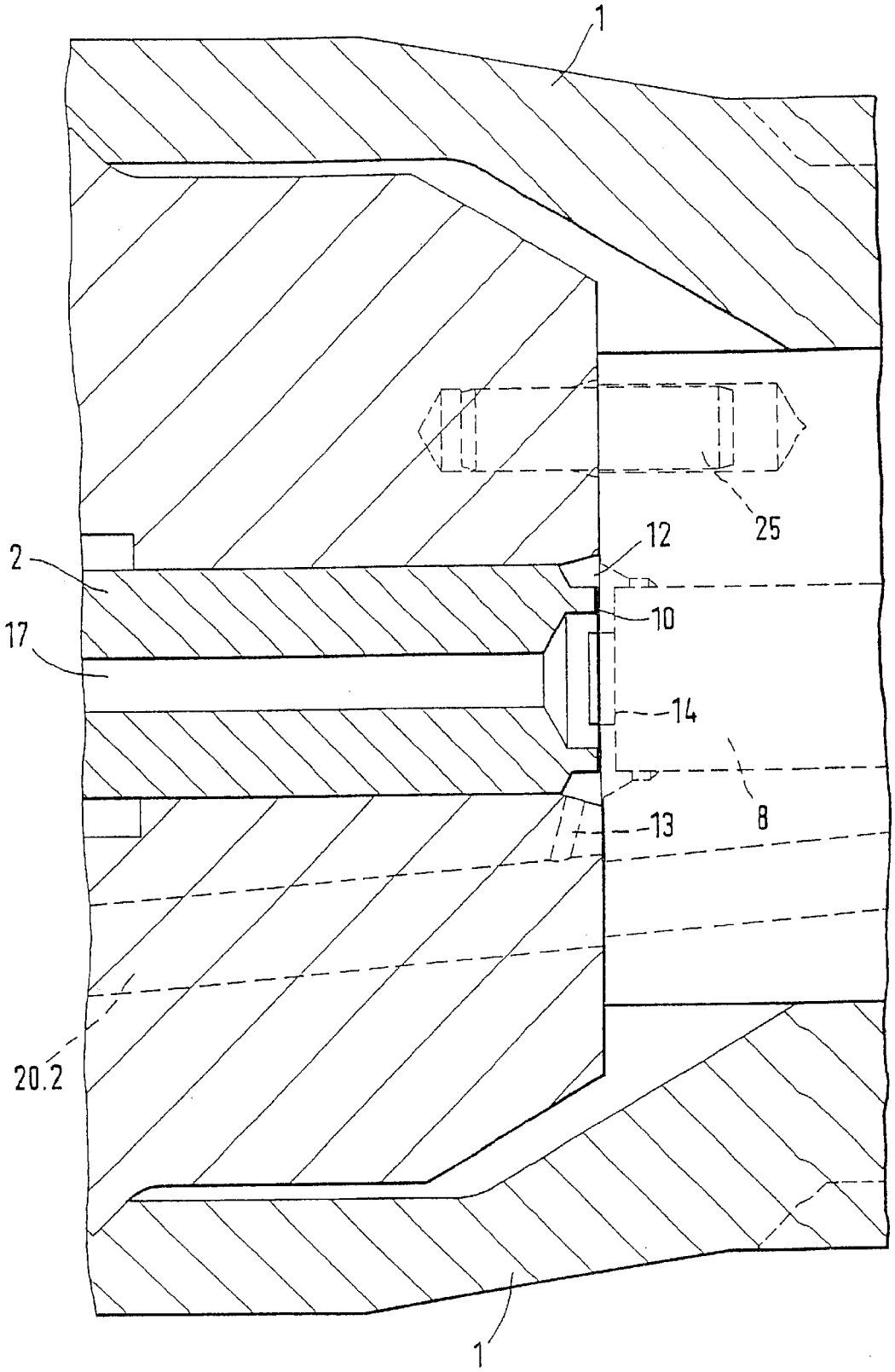

The mode of functioning of the injector described in greater detail in FIGS. 1 and 2 in accordance with the present invention is now represented as follows:

As long as the 2/2 way valve—preferably constructed as a rapidly switching solenoid valve—is not subjected to flow and the systemic pressure, that is, the high pressure of the high pressure collection space 22 is not being applied on the injection element 1, the locking spring 7 above the spherical valve 15 presses the casing 2 movably mounted in injector element 2 in the direction of nozzle needle seat 9. In this way, nozzle needle 8 is pressed on nozzle needle seat 9 so that its opening remains closed toward the combustion chamber, and no undesired exit of fuel, that is "redieseling," can occur.

If after the start of the internal combustion machine, the injector is acted upon with the high pressure of more than 1600 bar applied to the high pressure collection space, the fuel enters into the inlet bore hole 20.2 of injector element 1 through inlet opening 20.1. The fuel then stands on the one hand on nozzle needle seat 9, on the other also on the nozzle needle control space 12 through an opening acting as an inlet throttle 13. Since the diameter 14 of the end segment of the nozzle needle 8 projecting into nozzle needle control space 12 is dimensioned greater that the diameter of nozzle needle 8 on the nozzle needle seat 9, the closing force generated in the nozzle needle control space 12 is greater than the hydraulic force counteracting the closing force generated at the nozzle needle seat 9. The opening of nozzle 5 into the combustion chamber remains closed.

By actuation of the solenoid valve 6 through control unit 19, the spherical valve 15 frees the opening 16 acting as outlet throttle on the upper side of the casing 2 embedded in the injection element 1. Opening 16 is dimensioned larger than branch 13 from the high pressure bore hole 20.2, whereby the branch 13 opens into the nozzle needle control space 12 and acts as a throttle. In this way, the pressure in the nozzle needle control space 12 drops and the nozzle needle 8 moves with its end segment to the face of casing 2 in addition. In this manner, the nozzle needle 8 frees nozzle needle seat 9. Injection into the combustion chamber begins. The end of injection is brought about in that subjecting the solenoid valve to flow is stopped by the control unit 19. The spherical valve 15 closes off the outlet throttle 16, the solenoid valve control amount is returned to the storage tank 24 over the pressureless outlet 18 via the free space accommodating locking spring 7.

Since the bore hole 17 is executed in the casting 2, which extends through injection element 1 with a diameter of <1.5 mm, the high rate of flow in bore hole 17 is transformed into a high pressure wave that acts as a rise in pressure into the nozzle needle control space 12. The higher pressure entering there in a lightning-like manner acts on the end segment of the nozzle needle 8, more exactly stated on its face 14, and moves this in the direction of nozzle needle seat 9. The pressure in the nozzle needle control space increased in a sudden burst owing to the "hammer pipe effect" is greater than the in any case high pressure of the high pressure collection space 20.1 continually applying on the nozzle needle seat 9, that is than the pressure in the common rail. In this way, the closing of the nozzle opening into the combustion chamber occurs in injector element 1.

With this solution, leakage losses in solenoid valve control amount can be reduced, as an effective sealing of nozzle 5 is guaranteed on the combustion chamber side opening of nozzle 5. The solenoid valve control amount runs back into storage tank 24 and is not irretrievably lost but can once again be compressed as injection lot. The efficiency of the injector of the invention can consequently be considerably be improved, whereby this can take place with the minimum number of subassemblies necessary.

The foregoing relates to preferred exemplary embodiment of the invention, it being understood that other variants and embodiments thereof are possible within the spirit and scope of the invention, the latter being defined by the appended claims.

I claim:

1. An injector for injecting a fluid under high pressure by means of a nozzle (5), by use of an injector element (1) including a high pressure inlet line (20) having a pressure-less outlet (18), the injector being connected with a common high pressure collection source (22), and for actuation of the nozzle (5), a solenoid valve (6) is provided in the injector element (1) at an end thereof opposite the nozzle (5), the improvement wherein, in the injector element (1), a casing (2) is movably accommodated, said casing having one face which is actuatable by means of a valve (15), said valve (15) being provided in the injector element (1) between the solenoid valve (6) and the nozzle (5), and a second face (10) which bounds a control space (12) in which a branch (13) of a high pressure inlet (20.2) opens.

2. The injector according to claim 1, wherein on the solenoid end of casing (2), an opening (16) serving as a throttle is provided.

3. The injector according to claim 2, wherein said branch (13) of the high pressure inlet (20.2) opening on the control space side end of casing (2) is constructed as a throttle, and wherein the diameter of opening (16) of casing (2) exceeds the diameter of opening (13) of casing (2).

4. The injector according to claim 1, wherein said branch (13) of the high pressure inlet (20.2) opening on the control space side end of casing (2) is constructed as a throttle.

5. The injector according to claim 1, wherein said valve (15) provided on the solenoid side end of casing (2) is acted upon by a locking spring (7).

6. The injector according to claim 1, wherein comprises a dimensioned tolerance occurring between injector element (1) and casing (2) between a stop (11) and the control space side face (10) of casing (2) is <0.01 mm.

7. The injector according to claim 1, wherein, when control space (12) is acted upon through branch (13), nozzle needle (8) is pressed on its seat (9).

8. The injector according to claim 1, wherein said nozzle needle (8) has a needle diameter (14) on its face end which is greater than the nozzle needle diameter at the nozzle needle seat (9).

9. The injector according to claim 1, wherein said casing (2) extends through the injector element (1).

10. The injector in accordance with claim 1, wherein said nozzle (5) is positioned relative to the injector element (1) by means of a centering pin (25).

* * * * *